United States Patent [19]

Giebmanns

[11] Patent Number: 4,468,892

[45] Date of Patent: Sep. 4, 1984

[54] GRINDING MACHINE

[75] Inventor: Karl H. Giebmanns, Westport, Conn.

[73] Assignee: ITM International Tool Machines, Inc., Westport, Conn.

[21] Appl. No.: 284,410

[22] Filed: Jul. 17, 1981

[51] Int. Cl.[3] ..... B24B 7/00

[52] U.S. Cl. ..... 51/99; 51/165.77; 51/34 D

[58] Field of Search ..... 51/165.87, 99, 165.77, 51/34 C, 34 D; 125/13 SS

[56] References Cited

U.S. PATENT DOCUMENTS

| | | | |
|---|---|---|---|
| 2,693,057 | 11/1954 | Eastwood | 51/98 R |
| 2,998,812 | 9/1966 | Cooper | 125/13 SS |
| 3,562,959 | 2/1971 | Dooley | 51/99 |
| 3,641,709 | 2/1972 | Gazuit | 51/99 |
| 4,020,598 | 5/1977 | Harmant | 51/165.87 |
| 4,100,700 | 7/1978 | Peirce | 51/99 |

*Primary Examiner*—Harold D. Whitehead

[57] ABSTRACT

An improved grinding wheel support arrangement in a grinding machine. The support arrangement includes a support frame on which a support member is pivotally mounted at one of its free ends. A support leg is pivotally mounted on the support member at the other free end. A grinding wheel shaft supporting a grinding wheel is rotatable on the support leg. At least two separate adjusting means are operatively connected to the support frame; a first adjusting means being directly connected to the support frame and the second adjusting means being connected to the support leg to adjust the position of the grinding wheel relative to the support frame. The two separate adjusting means act in the plane of the grinding wheel in mutually intersecting directions.

5 Claims, 4 Drawing Figures

GRINDING MACHINE

BACKGROUND OF THE INVENTION

The invention relates to an arrangement of various axles in a grinding machine, which make it possible to precisely guide a grinding wheel. while at the same time sealing off the guide mechanism from the dirt and contamination formed during the operation of the device.

Grinding machines of the type described herein are used for grinding of, for example, slots, threads, exterior and interior diameters or front surfaces of workpieces.

In the conventional grinding machines, the grinding wheel is guided on a sliding carriage. This sliding carriage can be in the form of a saddle having a dove-tailed key and slot or a shaft slidably mounted in a mating bore. These guiding means have the drawback, that they may not be sufficiently tightly mounted to seal off the guiding means from the grinding dust or other contaminations that occur in grinding machines. Furthermore, these guiding means can only carry out the guiding in a predetermined direction. When it is necessary that the grinding disc be guided in more than one direction, then a plurality of guiding arrangements are required. The grinding dust and dirt that is produced penetrates into a guide path and prematurely reduces the precision of the guiding and thereby the operational precision of the grinding machine.

SUMMARY OF THE INVENTION

It is the object of this invention to provide a grinding machine where the possibility exists to precisely guide a grinding wheel so that a single guiding arrangement serves to guide the grinding wheel. Moreover, the arrangement provides for an effective sealing off of all movable parts of the guiding arrangement.

BRIEF DESCRIPTION OF THE DRAWING

With these and other objects in view, which will become apparent in the following detailed description, the present invention will be clearly understood in connection with the accompanying drawings, in which.

DETAILED DESCRIPTION

Figure 1:
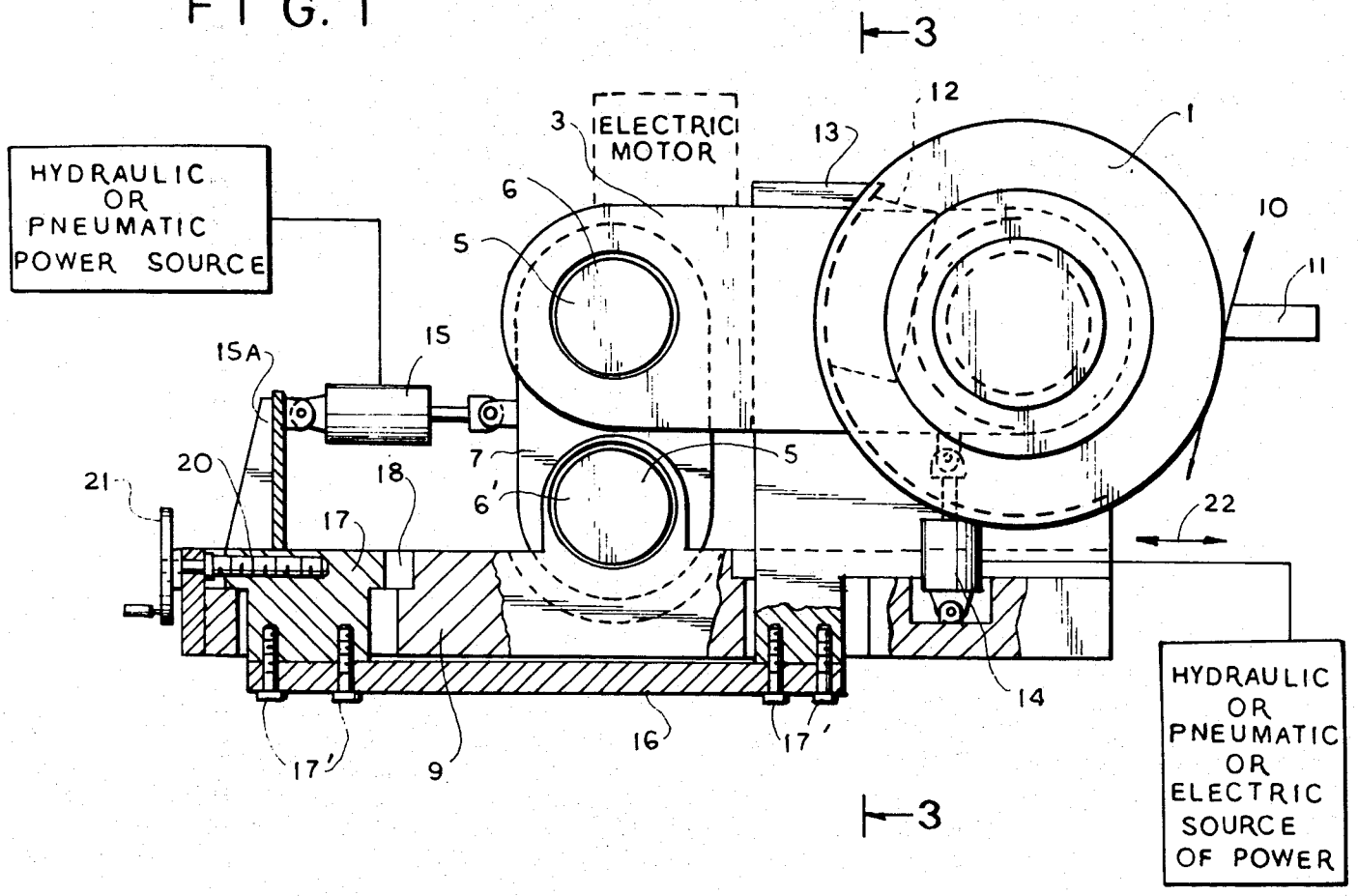
FIG. 1 is a side-elevational view, partially in section, of the grinding machine of the invention.

Referring now to the drawings there is illustrated in FIG. 1 a grinding disc 1 being coaxially mounted on a spindle 2 which is rotatably mounted in a support leg 3. The grinding disc 1 is rotated via a non-illustrated drive belt and belt pulley wheel 4 by a non-illustrated conventional motor drive means. Thus, for example, the electro-motor may be preferably mounted on the support leg 3 of the main housing. In order to make the guiding arrangement as dust-proof as possible, there are preferably used conical sealing bearings 5, which also serve to support the support leg 3 and at the same time seal off the guiding arrangement and the support for the shaft 6. The support shaft 6 is again connected via an intermediate arm 7 to a further support shaft 6′ mounted on the carrying frame 9. As can be noted the conical bearings 5 serve to seal off the bearing support for the shaft 6 and 6′. By means of the afore-described arrangement the grinding wheel or disc 1 can be precisely guided in a variety of directions which are all transverse to the axis of the grinding wheel 1.

Figure 2:
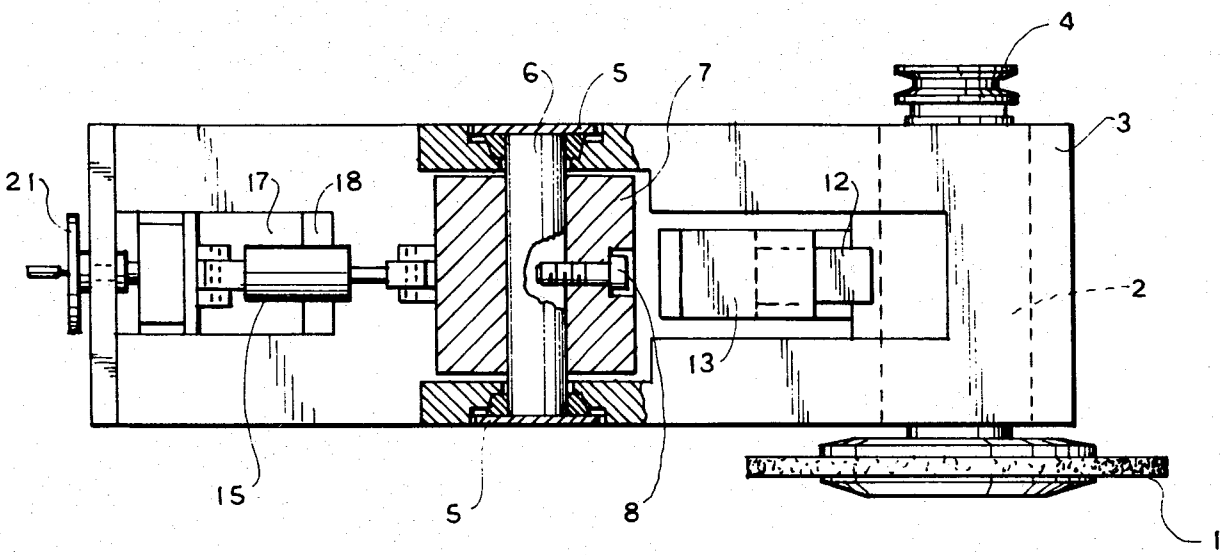
FIG. 2 is a top plan view of the grinding machine illustrated in FIG. 1.

Thus, for example, the grinding wheel 1, as is illustrated in FIGS. 1 and 2, can be guided along a guide surface of a guide templet 12 in the direction of the double arrow 10 to work on a work piece 11, whereby this work piece 11 is ground along an inclined surface represented by the double arrow 10. By adjusting the position of the guide templet 12 in the support 13 from the illustrated position into another position, it is possible to also change the grinding direction of the grinding wheel into a direction different from that illustrated by the double arrow 10.

In the illustrated position of the arrangement, cylinder 15, which may be a hydraulic or pneumatically actuated cylinder-piston arrangement, has the task to bias the support leg 3 against the guide templet 12. In certain cases the cylinder 15 can be replaced by a corresponding pressure or tension spring means. Cylinder 14, which may also be a hydraulic or pneumatic cylinder piston-arrangement, has the task to move the grinding wheel 1 in the direction of the arrow 10. Depending on the position of the guide templet 12, the functions of the two cylinders 14 and 15 can be respectively reversed, so that the cylinder 14 has as a task to push the support leg 3 against the guide templet 12 and the cylinder 15 has a task to move the grinding wheel 1 in the corresponding grinding direction. It is of course understood that both the cylinders 14 and 15 are connected to conventional sources of pneumatic or hydraulic power for purposes of selectively actuating the two cylinders during the grinding operation.

As is illustrated in the drawing, the support 13 is slidably mounted in the frame 9 by means of a guide arrangement 18. Thereby the possibility is provided to adjust the position of the guide templet 12, respectively the support 13 in the direction of the double arrow 22. Such adjustment becomes necessary when the grinding wheel 1, due to dressing by means of a diamond tool changes its outer diameter in a known manner, and therefore must be repositioned by the corresponding reduction in diameter with respect to the work piece. In this connection it becomes necessary to securely mount one end of the cylinder piston arrangement 15 on the sled 17 which is in turn securely fastened by means of threaded bolts 17′ to the connecting member 16, which assembly is slidable in the frame 9 by means of the guiding arrangement 18. The connecting member 16 rigidly connects the support 13 and the sled 17 to each other. Thereby it is possible to adjust the position of the cylinder 15 together with the support 13, relative to the frame 9 in view of the fact that cylinder 15 is rigidly mounted on the sled 17 via the leg 15A. This adjustment can be effected by way of a threaded spindle 20 which is threadably mounted in a bore of the sled 17 and the position of which can be adjusted by means of a hand wheel 21, which is rotatably mounted in the frame 9.

Depending on the position of the guide templet 12, the adjustability of the cylinder 15 can be dispensed with and only the support 13 needs to be adjusted.

The arrangement of the invention has the further advantageous feature of being capable of supporting the electro-motor and concomitant driving means on the guide mechanism without unduly stressing and loading said guide mechanism.

Figure 3:
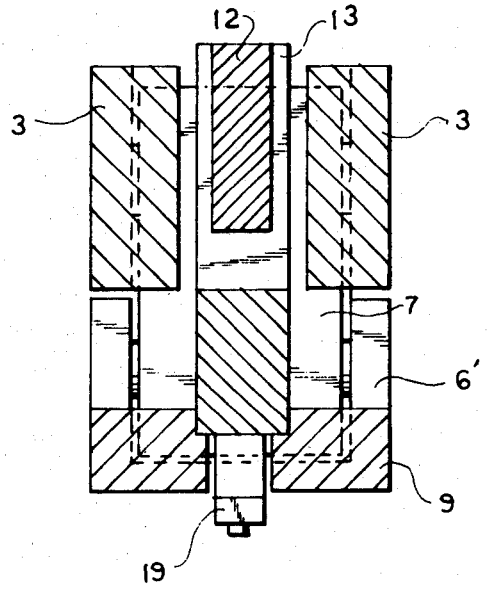
FIG. 3 is a sectional view along line 3—3 of FIG. 1.
Figure 4:
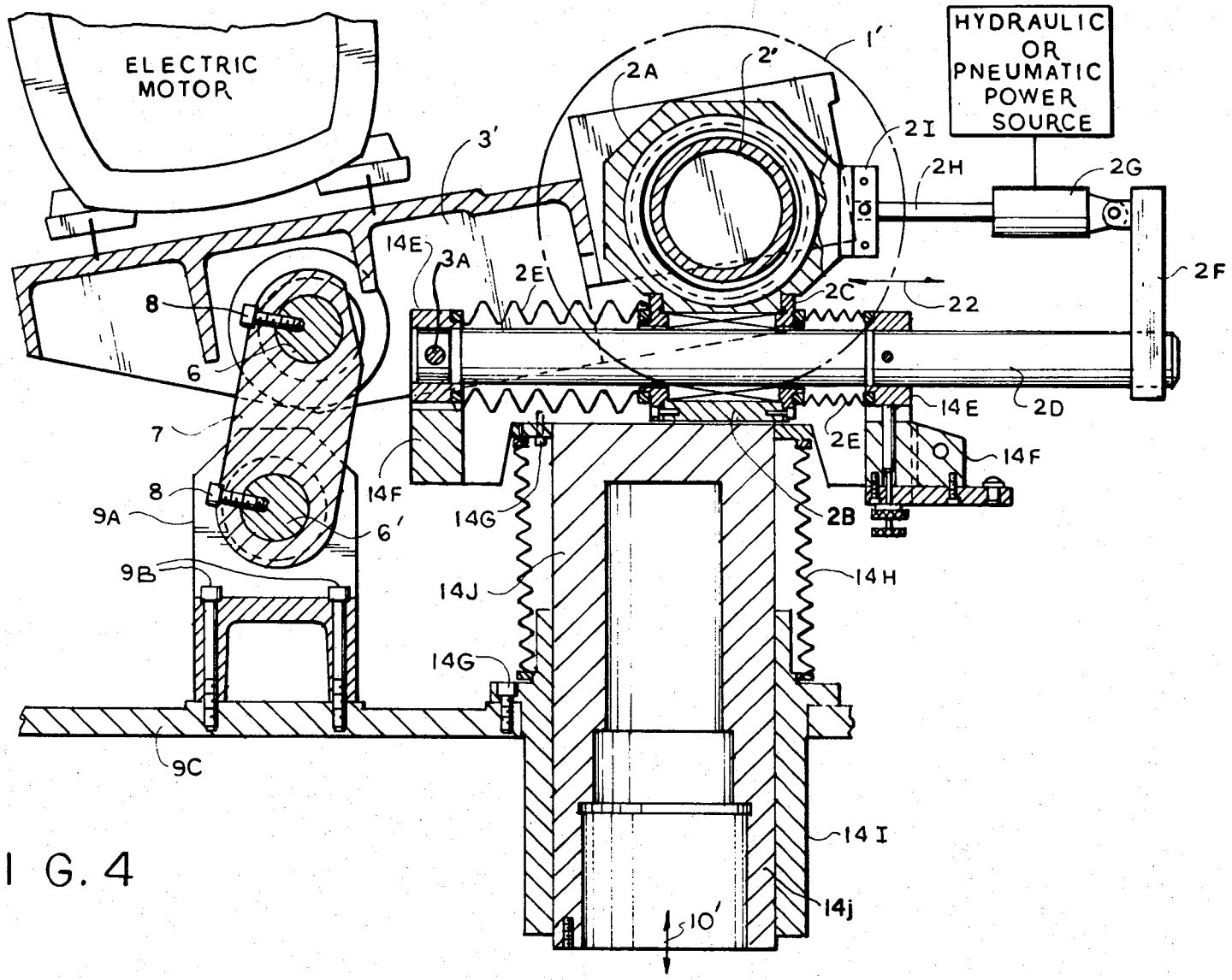
FIG. 4 is a side-elevational view partially in section, of an alternate embodiment of the grinding machine of the invention.

FIG. 4 illustrates an alternative embodiment of the grinding machine of the invention. In this embodiment those parts which are analogous to or equivalent to corresponding parts in the embodiment of FIGS. 1 to 3 have been designated with the same reference number plus the suffix "'". As can be noted in FIG. 4 the grinding wheel 1' is supported on the support leg 3' by means of a shaft 2' via bearing supports 2A. The bearing supports 2A are supported on a bushing 2B via a pair of flanges 2C; a rod 2D is slidable within the bore of the bushing 2B. Bellows 2E cover the exposed portions of the rod 2D and thereby protect the guide arrangement from contamination of grinding dust and other contaminants. A leg 2F is rigidly secured to the rod 2D. A hydraulic or pneumatic cylinder piston arrangement 2G is pivotally mounted on the leg 2F and a piston rod 2H is pivotally connected to a flange 2I which in turn is rigidly secured to the bearing support 2A. The cylinder piston arrangement 2G, 2H is operatively connected to a conventional hydraulic or pneumatic power source. Thereby the cylinder piston arrangement 2G, 2H can slidably move the entire grinding wheel support 2', 2A, 2B, 2C, on the rod 2D to thereby adjust the position of the grinding wheel 1'. As can be noted the leg 3' is supported on the frame 9C in a manner analogous to the embodiment of FIGS. 1 to 3, via shafts 6, 6' and via the intermediate arm 7. The bolts 8 fix the intermediate arm 7 to the shafts 6, 6'. The lower shaft 6' is pivotally mounted on a post 9A which is secured by bolts 9B onto the frame 9C.

The entire aforedescribed grinding wheel support arrangement is slidably movably supported on a movable post 14J which is slidable within a sleeve 14I. The post 14J is movable in the direction of the double arrow 10' by conventional mechanical means or conventional pneumatic or hydraulic means. The sleeve 14I is secured by bolts 14G to the frame 9C.

The exposed portion of the post 14J is surrounded by bellows 14H to thereby prevent contamination of the guide arrangement within the sleeve 14I. The rod 2D is supported by a pair of bearings and bearing supports 14E, 14F which are bolted to the top of post 14J via bolts 14G.

As can be noted from FIG. 4 the adjustability of grinding wheel 1' is somewhat different from that of the embodiment of FIGS. 1 to 3. In particular the movable guiding arrangement 18 has been dispensed with. In lieu of such guiding arrangement the bushing 2B, the end flanges 2C which support the grinding wheel 1' via the shaft 2' and bearing supports 2A, are reciprocally slidable along double arrow 22' by means of the hydraulic or pneumatic piston cylinder means 2G, 2H, whereas the bushing 2B is movable along the double arrow 10', relative to the frame 9C by means of the reciprocally movable post 14J in view of the pivotal connections of the support leg 3', the pivotal connection 3A between the rod 2D and bearing support 14F and the pivotal connections of the piston cylinder 2G, 2H, so that the entire assembly is capable of complex preselected movements.

Although the invention is illustrated and described with reference to a plurality of embodiments thereof, it is to be expressly understood that it is in no way limited to the disclosure of such preferred embodiments, but is capable of numerous modifications within the scope of the appended claims.

I claim:

1. In a grinding machine, an improved grinding wheel support arrangement, comprising in combination a support frame;

a support member being pivotally mounted in said frame at one of its two free ends;

a support leg being pivotally connected at one of its two free ends to the support member at the other one of the support member's free ends;

a grinding wheel shaft freely rotatable mounted on said support leg at the other one of the two free ends;

a grinding wheel coaxially mounted on the grinding wheel shaft;

a first separate adjusting means operatively mounted on the support frame, said fist adjusting means being positively linearly and only normally movably mounted relative to the support frame and having a free end which is operatively connected to the support leg to adjust the position of the grinding wheel relative to said support frame by only linearly moving the first adjusting means in a direction which is normal relative to said support frame, said first adjusting means acting in the plane of the grinding wheel; whereby the position of the grinding wheel is only adjustable in a plane parallel to the movement of the first separate adjusting means; and a second separate connected adjusting means connected to said support leg to adjust the position of said grinding wheel relative to said support frame jointly with said first adjusting means, said second adjusting means including a sled which is linearly slidably movably supported on said first adjusting means said second separate adjusting means being pivotally mounted on said leg and the first adjusting means including a piston-cylinder unit mounted on said frame.

2. In a grinding machine, the improved grinding wheel support as set forth in claim 1, wherein said sled includes cam surface means which are in abutting contact with said grinding wheel shaft.

3. In a grinding machine, the improved grinding wheel support as set forth in claim 1, wherein said first and second adjusting means are in the form of pneumatic or hydraulic piston cylinder arrangements which are operatively connected to conventional sources of hydraulic or pneumatic power, or electric power.

4. In a grinding machine, the improved grinding wheel support as set forth in claim 1, wherein a support rod is pivotally connected to said support leg, bushing means are slidably disposed on said support rod, said bushing means also freely rotatably support said grinding wheel.

5. In a grinding machine, the improved grinding wheel support as set forth in claim 1, wherein the first adjusting means comprises a projecting member which operatively supports bushing means mounted thereon, said grinding wheel shaft being rotatably mounted in said bushing means, said projecting member is linearly movably mounted relative to said support frame so as to be adapted to precisely adjust the position of the grinding wheel relative to said support frame.

* * * * *